US006997170B2

(12) United States Patent
Feiner et al.

(10) Patent No.: US 6,997,170 B2
(45) Date of Patent: Feb. 14, 2006

(54) EXHAUST GAS RECIRCULATION (EGR) MODULE HAVING SENSOR INTEGRATED INTO COVER (ESM)

(75) Inventors: Aaron Feiner, Oak Park, MI (US); Mark A. Duda, Washington Township, MI (US); Scott Hussey, Clinton Township, MI (US); Bennett J. Arndt, Canton, MI (US); Peter G. Weissinger, Sterling Heights, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/876,753

(22) Filed: Jun. 25, 2004

(65) Prior Publication Data

US 2005/0028798 A1 Feb. 10, 2005

Related U.S. Application Data

(60) Provisional application No. 60/482,647, filed on Jun. 25, 2003.

(51) Int. Cl.
*F02B 47/08* (2006.01)

(52) U.S. Cl. ..... 123/568.29

(58) Field of Classification Search ..... 123/568.29, 123/568.21, 568.22, 568.27
See application file for complete search history.

(56) References Cited

U.S. PATENT DOCUMENTS

| | | | | |
|---|---|---|---|---|
| 6,116,224 | A * | 9/2000 | Cook et al. | 123/568.27 |
| 6,138,652 | A * | 10/2000 | Cook et al. | 123/568.27 |
| 6,170,476 | B1 * | 1/2001 | Cook et al. | 123/568.27 |
| 6,189,520 | B1 * | 2/2001 | Cook et al. | 123/568.27 |
| 6,230,694 | B1 * | 5/2001 | Cook et al. | 123/568.11 |
| 6,378,510 | B1 * | 4/2002 | Green et al. | 123/568.27 |

* cited by examiner

*Primary Examiner*—Mahmoud Gimie
(74) *Attorney, Agent, or Firm*—Warn, Hoffmann, Miller & LaLone, P.C.; Greg Dziegielewski

(57) ABSTRACT

A new and improved EGR valve having a valve body having an inlet port and an outlet port with a valve member moveably supported within the valve body between the inlet and outlet ports. A control cap is connected to the valve body and contains an integrated sensor that is used to provide an engine control module with pressure readings from the valve body and the interior portion of the cap. Additionally the cap also has an integrated zero emissions system that is capable of preventing the release of harmful chemicals into the atmosphere.

27 Claims, 7 Drawing Sheets

EXHAUST GAS RECIRCULATION (EGR) MODULE HAVING SENSOR INTEGRATED INTO COVER (ESM)

CROSS-REFERENCE TO RELATED APPLICATIONS

This application claims the benefit of U.S. Provisional Application No. 60/482,647, filed Jun. 25, 2003.

FIELD OF THE INVENTION

The present invention relates to a high flow exhaust gas recirculation (EGR) module having a sensor integrated into the cover of the electronic system module (ESM).

BACKGROUND OF THE INVENTION

Federal and State legislation require control of vehicle exhaust emissions. Oxides of Nitrogen (NOx) are among the exhaust gas emissions that must be controlled. Formation of undesirable NOx gas will occur when there is a high combustion temperature inside of the engine. In an effort to remove or reduce combustion temperatures and NOx emissions, exhaust gas recirculation (EGR) valve systems have been developed. EGR valves function by recirculating a portion of the exhaust gas back to the intake manifold where it will be combined with incoming outside air. The mixing of the exhaust gas and the outside air will displace oxygen in the air intake system. When the mixture is compressed and ignited in the cylinder, the result is a lower combustion temperature (due to the lower levels of oxygen) and a reduction in $NO_x$.

There is a need in the art for exhaust gas recirculation systems to reduce the number of components needed to effectively recirculate exhaust gas to the air/fuel mixture. Such systems reduce the complicated on-board plumbing of the type required for vacuum actuated EGR systems.

A typical EGR valve configuration using vacuum control uses an electrically actuated vacuum regulator (EVR) and a differential pressure sensor, also known as a delta pressure sensor. In turn, signals to and from these components are controlled by an engine control module (ECM). The effective control and simultaneous coordination of the various EGR components present some difficult challenges. More specifically, it is important to precisely actuate the EGR valve so that $NO_x$ ignitions may be optimally minimized. However, as the number of components employed in an EGR valve system increases so will the system response time. This makes it more difficult and costly to control the overall process. In related art, the EGR, EVR and delta pressure sensor are typically separate components mounted at various places on the engine and interconnected via flexible or hard conduits referred to as "on-board plumbing." In systems presently employed in the related art, each component often requires its own mounting strategy and associated fasteners. The on-board plumbing must be routed so as not to clutter the engine. This object is not always met in EGR systems presently used in the field today it can be difficult and expensive to service. Further, and because of ever shrinking space available for the vehicle power plant, the effective use of space through efficient component packaging is a parameter which designers must constantly seek to improve.

Thus, there is a need in the art of exhaust gas recirculation systems which reduces the number of components needed to effectively re-circulate gas to the air/fuel mixture. Further, there is a need for such a system that reduces the complicated on-board plumbing of the type required for vacuum actuated EGR systems. There is also a need in the art for an exhaust gas re-circulation system that is easy and inexpensive to service in the field. Finally, there is a need in the art for an exhaust gas re-circulation system which has improved response time and accurate repeatability and is smaller than present systems employed in the related art.

SUMMARY OF THE INVENTION

The present invention is directed to a new and improved EGR valve for use in an automobile emissions system. The valve includes a valve body having an inlet port and an outlet port with a valve member moveably supported within the valve body between the inlet and outlet ports. A diaphragm housing is operatively mounted to the valve body and defines a vacuum cavity that is in fluid communication with a second source of pressure. A diaphragm member is disposed between the vacuum cavity and the valve body. The diaphragm member is moveable in one direction in response to a negative pressure induced in the vacuum cavity, and in the opposite direction in response to a biasing force associated with the valve member to effectively move the valve member between the open and closed position.

The diaphragm housing is contained by a control cap that is connected to the valve body. Inside of the control cap is a vacuum regulator that is operatively connected to the diaphragm housing. The vacuum regulator is operable to control the movement of the valve member between the open and closed positions by controlling the negative pressure induced in the vacuum cavity. The control cap also has a first conduit partially disposed through the cap, having one end of the first conduit operatively connected to the valve body near the inlet port. A second conduit is also partially disposed through the cap and has one end operatively connected to the vacuum cavity. A sensor is operably positioned with respect to the first and second conduits. The sensor has a first tower that is positioned inside of the first conduit and a second tower that is positioned inside of the second conduit. The first tower is configured to sense a first characteristic, such as pressure, inside of the first conduit. The first tower transmits a signal value that is indicative of the value of the first characteristic. The second tower is configured to sense a second characteristic, such as pressure, inside of the control cap and transmits a signal value that is indicative of the value of the second characteristic. Lastly a seal element is molded over the first and second towers so that the control cap encapsulates the first and second towers and protects from the external environment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
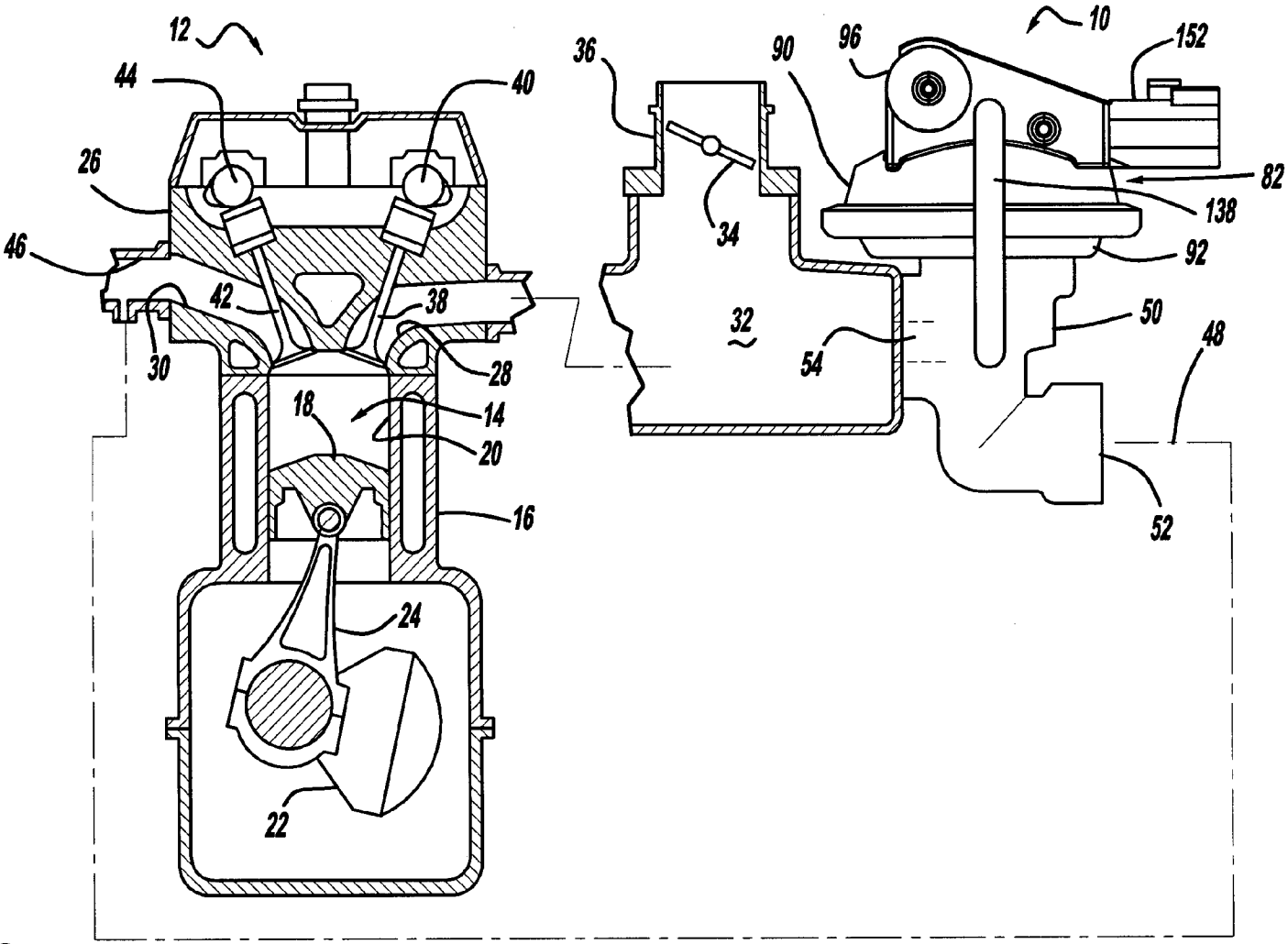
FIG. 1 is a schematic view of an internal combustion engine having the improved exhaust gas recirculation system of the present invention.

An exhaust gas recirculation system 10 of the present invention is shown in FIG. 1 in conjunction with a schematically illustrated internal combustion engine generally shown at 12. Thus, the internal combustion engine 12 is shown in FIG. 1 having one representative combustion chamber, generally indicated at 14, formed in an engine block 16. A piston 18 is supported for reciprocal motion within a cylinder 20. Together, the piston 18 and cylinder 20 define the combustion chamber 14. Reciprocal motion of the piston 18 in response to a combustion cycle in the cylinder 20 imparts rotary motion to a crankshaft 22 via the connecting rod 24 as is commonly known in the art.

A head 26 is mounted to the engine block 16 and includes at least one intake port 28 and at least one exhaust port 30. The intake port 28 is in fluid communication with an intake manifold, schematically represented at 32. Combustion air is drawn into the manifold 32 past a throttle 34 mounted in a valve body 50 where it is mixed with partially atomized fuel vapor. The throttle 34 moves to adjust the opening of the valve body 50 to adjust the amount of air flowing into the intake manifold 32 in response to certain predetermined parameters such as engine load, vehicle acceleration, etc. to regulate the air/fuel mixture to an optimum ratio.

In turn, the flow of the combustible air/fuel mixture into the cylinder 20 via the intake port 28 of the head 26 is controlled by one or more intake valves 38. The intake valves 38 may be supported in the head 26 for reciprocating motion under the influence of a camshaft 40 to open and close fluid communication between the intake port 28 and the cylinder 20, as is commonly known in the art.

Similarly, an exhaust valve 42 may be supported in the head 26 for reciprocating motion under the influence of a cam shaft 44 to open and close fluid communication between the cylinder 20 and the exhaust port 30. When the exhaust valve 42 is open, the products of combustion, including exhaust gases having partially combusted pollutants such as $NO_x$ are communicated to an exhaust manifold 46 through the exhaust port 30 formed in the head 26.

Where it is desired that the amount of pollutants should be reduced, a portion of the exhaust gas may be drawn off from the exhaust manifold 46 or any other suitable location on the engine and communicated to EGR system 10. Fluid communication of exhaust gases from its source (the combustion cylinder 20) to the EGR system 10 is schematically represented by a dotted line 48. Thus, those having ordinary skill in the art will appreciate that any suitable means for achieving this type of fluid communication may be employed without departing from the scope of the invention.

The EGR system 10 can be mounted at any convenient location on the engine 12. Referring now to FIG. 1 in conjunction with FIGS. 2–7 the EGR system 10 is in fluid communication with both the intake manifold 32 and the exhaust manifold 46.

Figure 2:
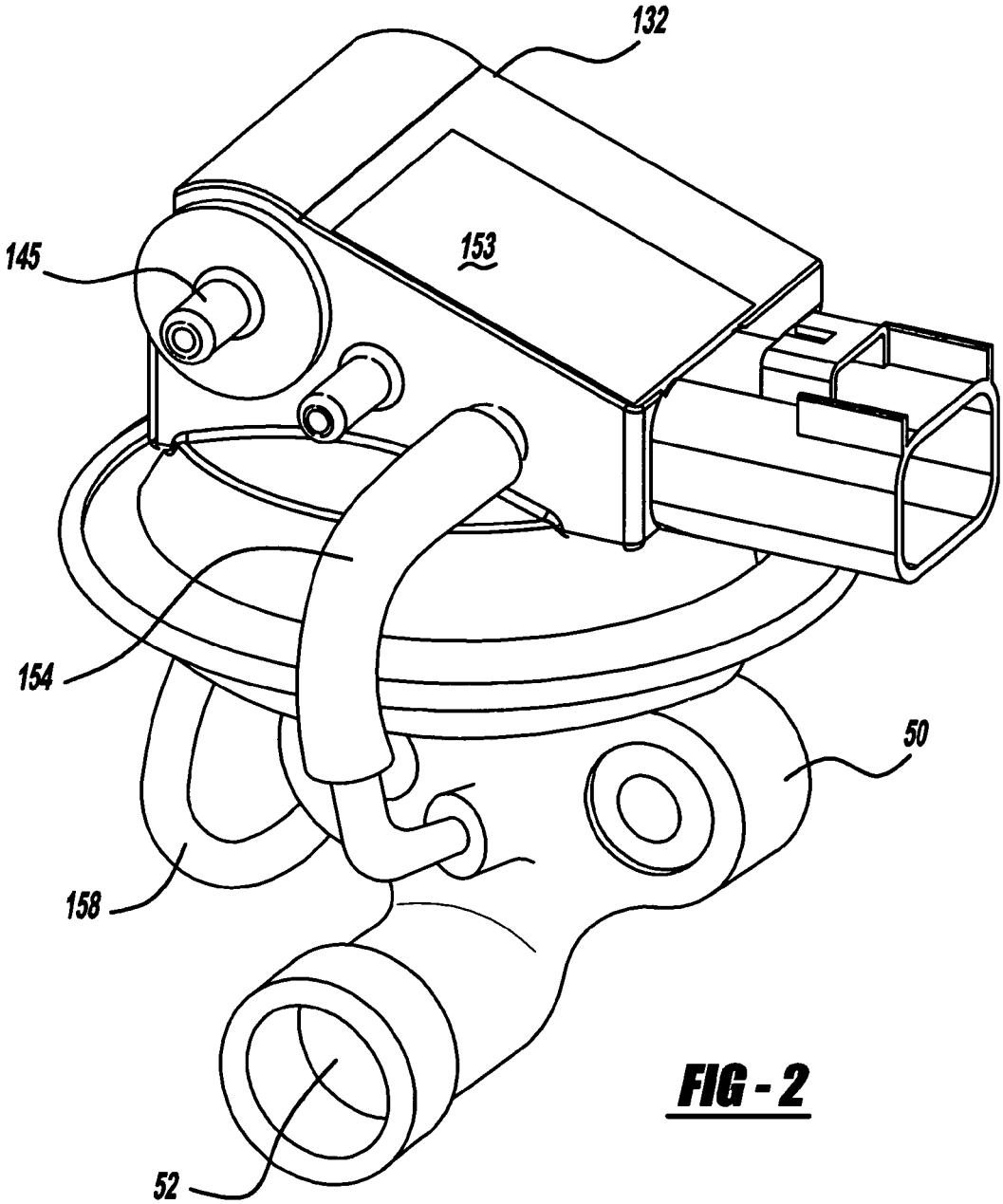
FIG. 2 is a perspective side view of the exhaust gas recirculation valve having a sensor integrated into the cover.
Figure 3:
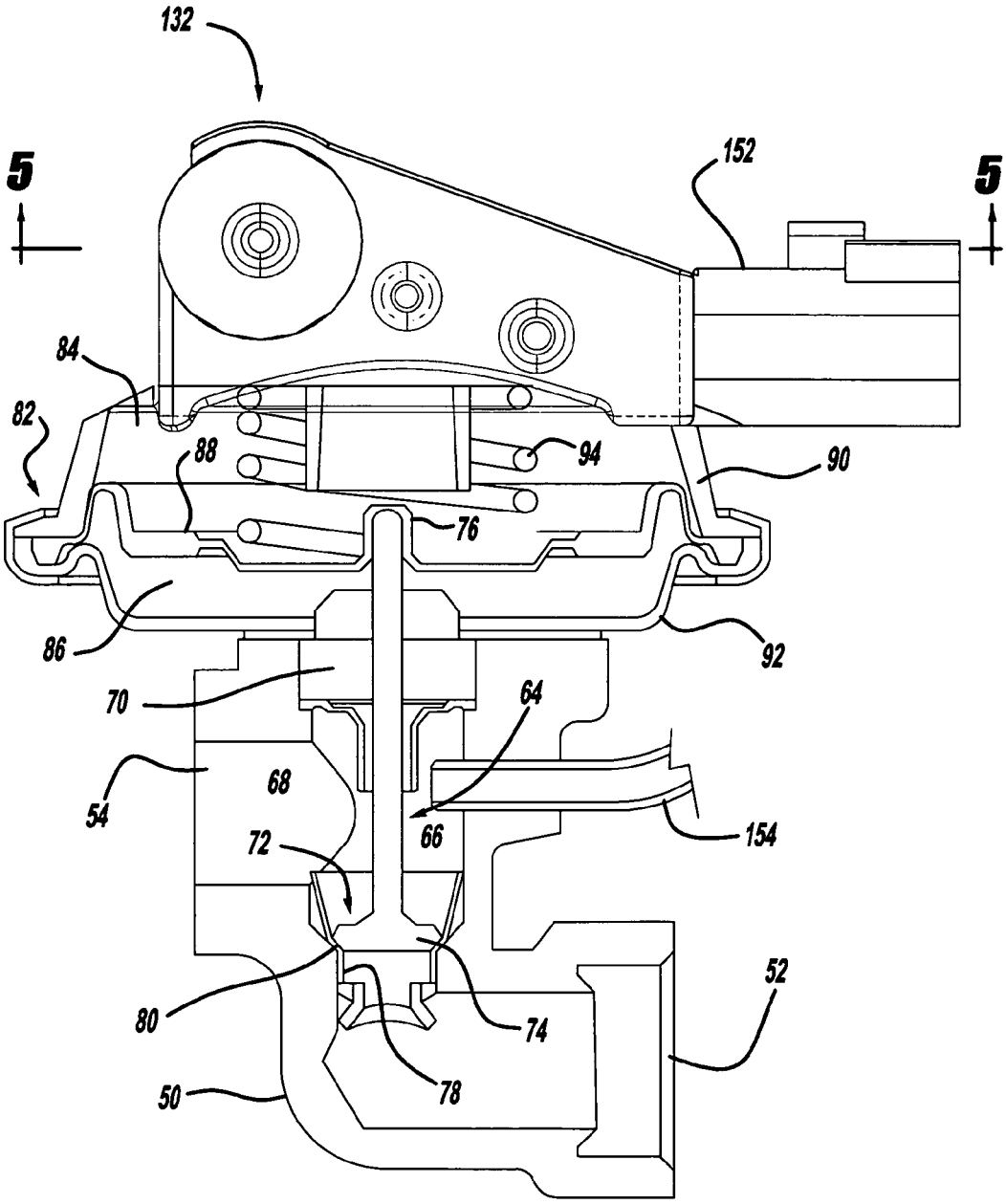
FIG. 3 is a cross-sectional side view of the exhaust gas recirculation valve.
Figure 4:
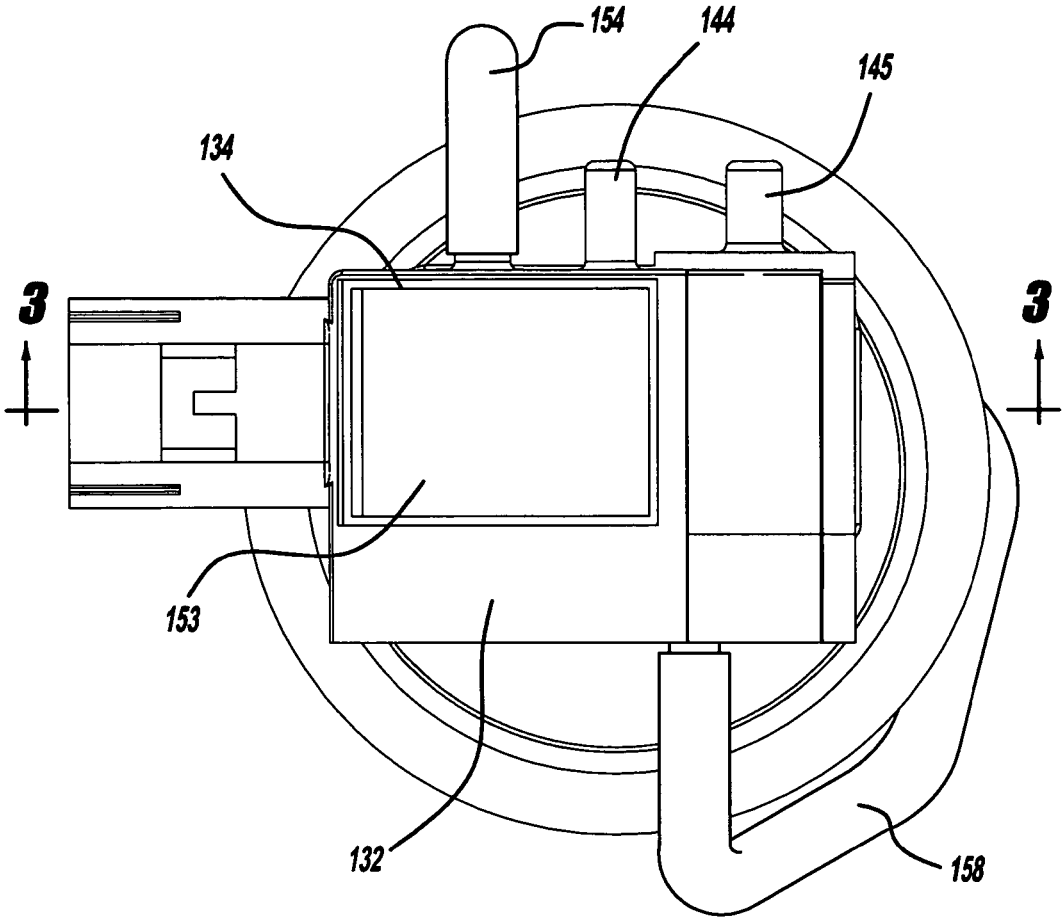
FIG. 4 is an overhead plan view of the exhaust gas recirculation valve having a sensor integrated cover.

Referring to FIGS. 2–3, the EGR system 10 includes a valve body 50, having an exhaust port 52 which is adapted for fluid communication with a source of exhaust gas. In the embodiment illustrated in FIG. 1, this fluid communication is effected with the exhaust manifold 46 via one or more conduits represented by the dotted line 48. In addition, the valve body 50 is preferably a cast part that includes an intake port 54 which is adapted for fluid communication with the intake manifold 32 of the internal combustion engine 12. In the embodiment illustrated in FIG. 1, the EGR system 10 is mounted directly to the intake manifold 32 and communicates therewith via a passage 56. However, those having ordinary skill in the art will appreciate that the EGR system 10 may be mounted at any convenient place on the engine 12.

The EGR system 10 also includes a valve member 64. The valve member 64 is movable between open and closed positions to control the flow of exhaust gas from the exhaust port 52 to the intake port 54 of the EGR system 10. More specifically, the valve member 64 includes a valve element 66 and a valve stem 68 extending from the valve element 66 and through a bushing 70 in the valve body 50. The valve element 66 is received on a valve seat 72 formed in the valve body 50 at the exhaust port 52 when the valve member 64 is in its closed position. The valve seat 72 includes a generally frustoconically shaped insert which defines a first, generally larger diameter portion 76 and a second generally smaller diameter portion 78 with a transition portion 80 extending therebetween. On the other hand, the valve element 66 includes an annular shoulder 74 adapted to sealingly engage the transition portion 80 of the valve seat 72 when the valve member 64 is in its closed position. The valve seat 72 and valve element 66 act to induce turbulent flow of the exhaust gases as they move past the valve seat 72 when the valve member 64 is moved to its open position. Turbulent flow of the exhaust gases is conducive to better mixing between the recirculated exhaust gas and the fresh intake air received into the intake manifold 32.

Above the bushing 70, the valve stem 68 includes a nipple 76 formed at the distal end thereof. The purpose of the nipple is discussed in greater detail below. More specifically, the valve stem 68 defines a longitudinal axis A of the valve member 64. Thus, in the embodiment disclosed herein, the exhaust gas recirculation system 10 employs a "pull to open" type valve arrangement.

The exhaust gas recirculation system 10 further includes a diaphragm housing 82 that is operatively mounted to the valve body 50 and supported thereby. The diaphragm housing 82 defines a vacuum cavity 84 in fluid communication with a source of negative pressure such as exists in the intake manifold 32 under certain engine operating conditions. The diaphragm housing 82 also defines an atmosphere cavity 86 that is in fluid communication with a source of second pressure. In the preferred embodiment, the source of second pressure is the ambient atmospheric pressure. A flexible diaphragm member 88 is disposed between the vacuum cavity 84 and the atmosphere cavity 86 and is operatively connected to the valve member 64. More specifically, the diaphragm member 88 is made of a steel reinforced neoprene or some other suitable flexible material. The valve member 64 is operatively connected to the diaphragm member 88 via a mechanical attachment at the nipple 76 located at the distal end of the valve stem 68. The diaphragm member 88 is movable in one direction in response to a negative pressure induced in the vacuum cavity 84 and in an opposite direction in response to a biasing force to move the valve member 64 between its open and closed positions as will be described in greater detail below.

The diaphragm housing 82 includes an upper housing member 90 and a lower housing member 92 with the diaphragm member 88 operatively supported therebetween so as to define the vacuum and atmosphere cavities, 84, 86 respectively. The lower housing member 92 is supported by the valve body 50. A biasing member 94 is supported within the diaphragm housing 82 and between the upper housing member 90 and the diaphragm member 88. The biasing member 94 serves to bias the valve member 64 toward its closed position. In the preferred embodiment illustrated in these figures, the biasing member is a coiled spring 94. However, those having ordinary skill in the art will appreciate that any number of biasing mechanisms commonly known in the related art may be employed for the same purpose.

Figure 5:
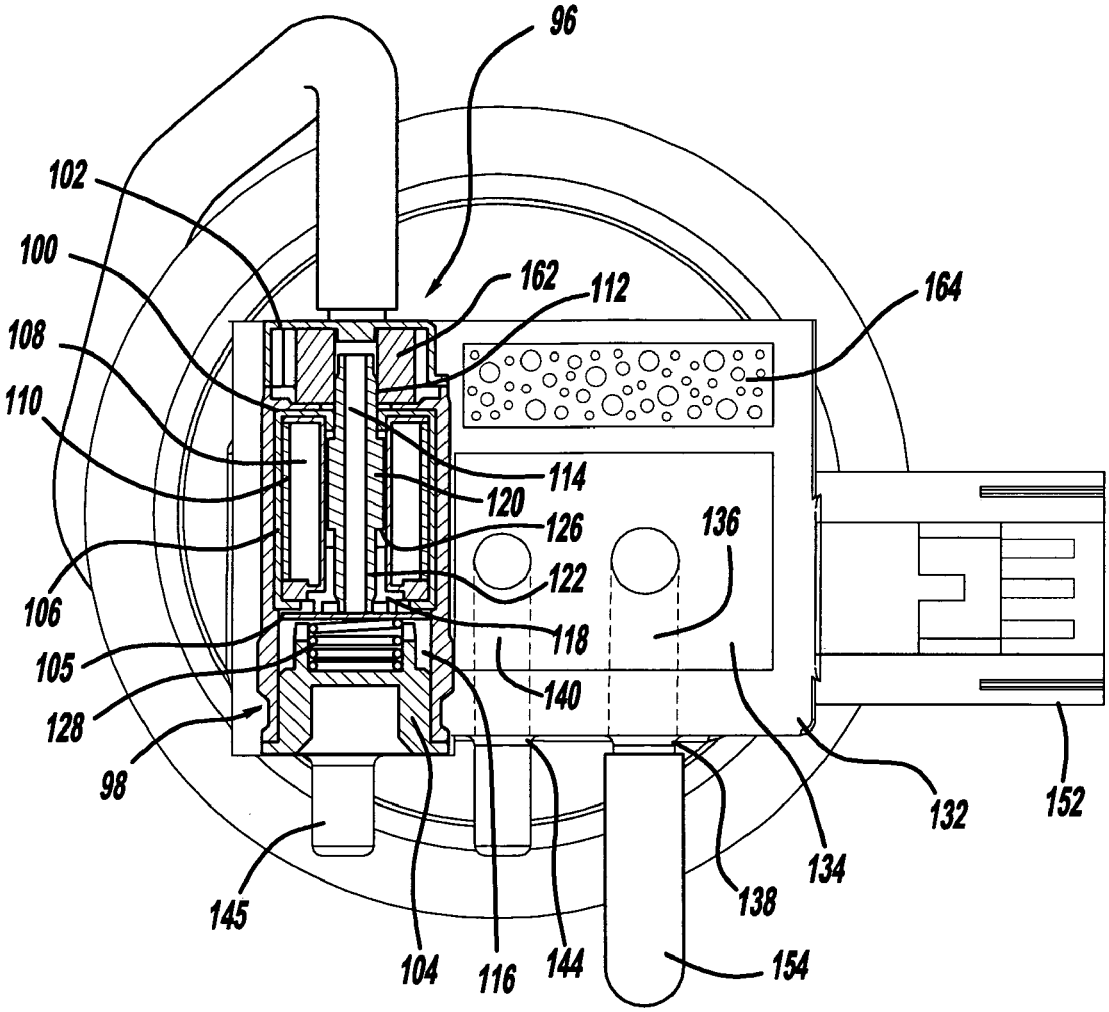
FIG. 5 is an overhead cross-sectional plan view of the exhaust gas recirculation valve having a sensor integrated cover.
Figure 6:
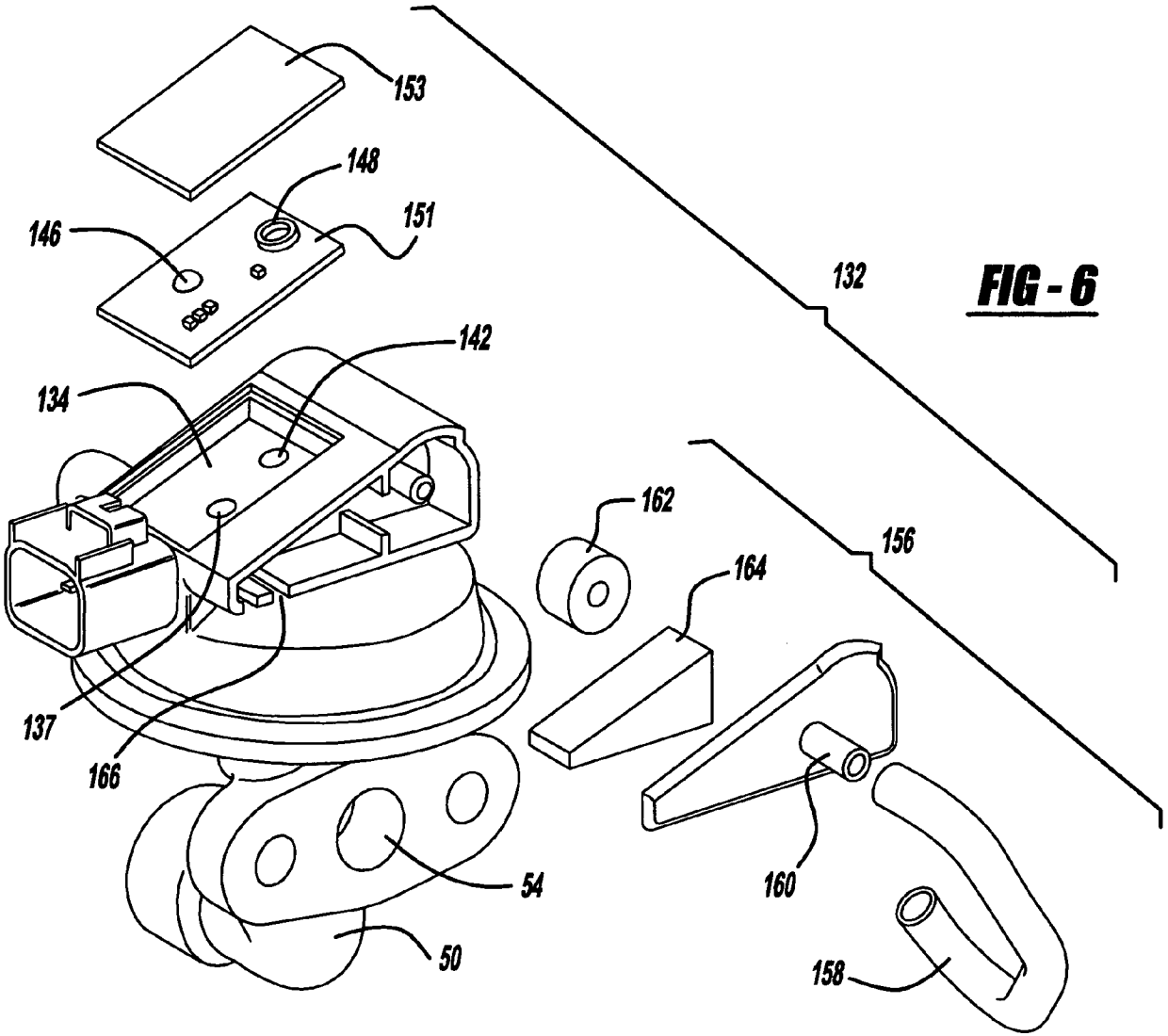
FIG. 6 is an exploded side perspective view of the sensor integrated cap.
Figure 7:
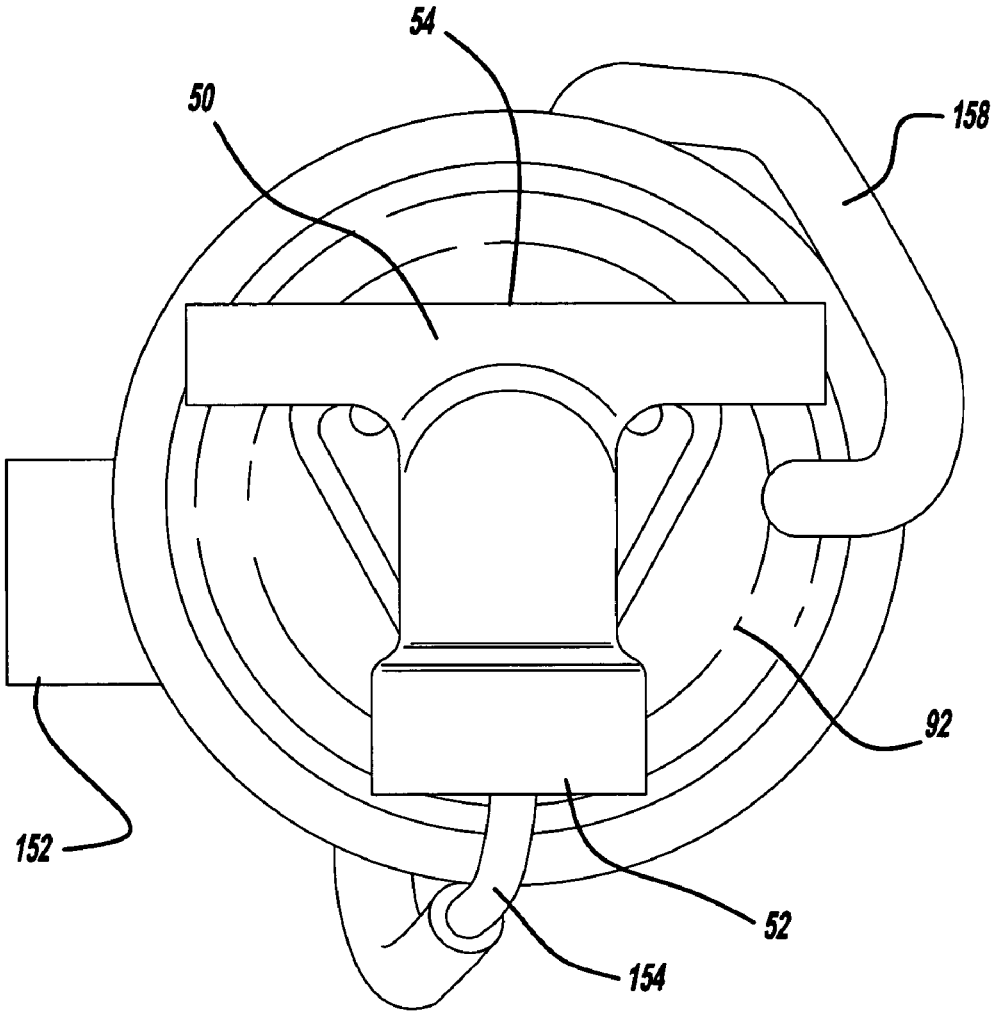
FIG. 7 is a bottom plan view of the exhaust gas recirculation valve having a sensor integrated cover.

FIGS. 5 and 6 depict an exploded side perspective view of a sensor integrated cap 132. The cap 132 is configured to be connected to the valve body 50. The cap 132 has a pocket 134 that is a recess molded into the surface of the cap 132. A first conduit 136 has a first end 137 that terminates inside of the pocket 134, and a second end that terminates at a nozzle 138 protruding from the external surface of the cap 132. A second conduit 140 has a first end 142 that terminates inside of the pocket 134 and a second end that terminates at a nozzle 144 protruding from the external surface of the cap 132. A first tower 146 (also called a first die well) is positioned in the first conduit 126 at the first end 137. A second tower 148 (also called a second die well) is positioned in the second conduit at the first end 142. The first and second towers 146, 148 are connected to a lead frame 150 to collectively form a sensor 151. The lead frame 150 is connected to a connector 152 and functions to transmit signals from the first and second towers 146, 148 out of the cap 132 to the ECM (not shown).

A seal element 153 is placed over the sensor 151 to encapsulate the sensor 151 in the pocket 134 of the cap 132. This protects the sensor 151 from the external environment outside the cap 132.

The exhaust gas recirculation system 10 of the present invention also includes and integrated vacuum regulator 96 contained within the cap 132. The integrated vacuum regulator 96 is operable to control the movement of the valve member 64 between its opened and closed positions by controlling the negative pressure induced in the vacuum cavity 84. The vacuum regulator 96 has a solenoid assembly 100 that acts to control the negative pressure induced in the vacuum cavity 84 as will be described in greater detail below.

The vacuum regulator housing 98 includes a pair of cup shaped end caps 102,104 and a solenoid frame 106 extending therebetween, the vacuum regulator housing 98 is in fluid communication with vacuum cavity 84. The solenoid assembly 100 includes a solenoid coil 108 and a bobbin 110. A ferromagnetic valve member 105 is movably supported within the vacuum regulator housing 98 between open and closed positions in response to an electromagnetic force generated by the solenoid coil 108 thereby controlling the pressure in the vacuum cavity 84. The solenoid coil 108 is connected to a source of electrical current which is inputted into the cap 132 via the connector 152. In addition, the solenoid assembly 100 includes a fixed, ferromagnetic pole piece, generally indicated at 112, having a passage 114 extending therethrough. The ferromagnetic valve member 105 is disposed in spaced relationship relative to the pole piece 112 even when the valve member 105 is in its closed position. More specifically, and to this end, the solenoid assembly 100 includes a sleeve 116 that is located between the pole piece 112 and the coil bobbin 110. The sleeve 116 presents an annular valve seat 118. The solenoid valve member 105 is disposed in abutting relationship relative to the annular valve seat 118 when the valve member 105 is in its closed position. Furthermore, the annular valve seat 118 serves to space the solenoid valve member 105 from the pole piece 112.

The pole piece 112 includes a body 120 and a stepped portion 122 having a smaller diameter cross-sectional area than the body 120. The sleeve 116 presents a first, larger diameter portion 124 and a second, smaller diameter portion 125 with a shoulder 126 defined therebetween. The stepped portion 122 of the body 120 of the pole piece 112 is received in cooperating relationship with the shoulder 126 of the sleeve 116 thereby mechanically fixing the pole piece 112 relative to the sleeve 116.

The solenoid assembly 100 also includes a biasing member 128 which biases the solenoid valve member 105 into engagement with the valve seat 118 thus making the valve member be in a normally open position when the solenoid valve member 105 is de-energized. In the preferred embodiment illustrated in these figures, the biasing member 128 is a coiled spring supported between one of the cup shaped end caps 104 of the vacuum regulator housing 98 and the solenoid valve member 105. However, those having ordinary skill in the art will appreciate that any number of biasing mechanisms may be used to accomplish this purpose.

The nozzle 138 of the first conduit 136 is connected to the inlet port 54 of the valve body 50 using a tube 154. The tube 154 is used to transfer a first characteristic which in the present embodiment is the vacuum pressure at the inlet port 54 to the first tower 146 located in the first conduit 136. The first tower 146 is configured to allow the sensor 151 to read the first characteristic. The second tower 148 extends partially into the second conduit 140 at a first end and has a second end that extends through the sensor 151 and terminates above the sensor 151. The second tower 148 is configured to allow the sensor 151 to read the value of a second characteristic. In the present embodiment the second characteristic is the pressure inside of the cap 132. Having the two ends of the second tower 148 located above and below the sensor 151 allows for a more accurate pressure reading. The second conduit 140 has a nozzle 144 that allows for pressure to exit the cap 132 and move onto a source (not shown). The sensor 151 compares the values of the first and second characteristics and generates a delta value. The delta value is transmitted using the lead frame 150 though the connector 152 and onto the ECM located externally from the cap 132. In an alternate embodiment it is possible for the sensor 151 to transmit signal values indicating the value for each characteristic, thus eliminating the need to use a delta sensor 151.

The cap 132 also has a vacuum nozzle 145 connected to the external surface. The vacuum nozzle 145 serves to supply to the cap 132 a source of vacuum pressure. The vacuum pressure is supplied from components that are external to the EGR system 10. The vacuum pressure supplied through the nozzle 145 is what the second tower 148 is sensing when it generates a value indicative of the second characteristic. The pressure inside of the cap 132 can be controlled by the vacuum regulator 96. The vacuum nozzle 145 supplies a vacuum to the cap. When the ECM determines that the negative pressure inside of the cap 132 is too great, a signal is sent via the connector 152 to the vacuum regulator 96. The signal causes the vacuum regulator 96 to energize the solenoid assembly 100 that causes the ferromagnetic valve member 105 to move away from the valve seat 118 (e.g. the open position). The movement of the valve member 105 to the open position allows atmospheric air pressure to enter the cap 132 via atmospheric vents 166. When this occurs the vacuum pressure inside of the cap 132 will drop and cause the biasing member 94 to press against the diaphragm member 88 to move the valve member 64 against the valve seat 72 to close the valve member 64. When the signal generated from the sensor 151 causes the ECM to send a control signal to close the vacuum regulator 96 the vacuum pressure inside of the cap 132 will increase and cause the diaphragm member 88 to be pulled upward against the opposing force of the biasing member 94. When the diaphragm member 88 moves upward, the valve element 66 will move away from the valve seat 72 to open the valve member 64 to allow the passage of exhaust gas from the exhaust port 52 to the intake port 54. In this situation the pressure in the atmospheric cavity 86 is greater than the pressure in the vacuum cavity 84.

The characteristics measured by the first and second towers 146, 148 can be any type of condition that can exist at the inlet port 54. In a preferred embodiment of the invention the first characteristic is the pressure (e.g. amount of vacuum) being induced at the inlet port 54 by the intake manifold 32. However, the first characteristic sensed by the first sensor 146 can be other characteristics $NO_x$, $CO_2$, $O_2$, CO composition, air temperature, humidity, the pressure or absence of solid particles etc., all of which depend on the type of application the valve is being used. For example, the EGR system 10 could be used for non-EGR functions such as a fuel vapor canister purge valve, an oil pump or a fluid pump such as the type used in transmission or clutch systems.

One of the problems with conventional EGR systems is that they can leak emissions from the valve body 50. This occurs when the valve member 64 moves to the closed position and the amount of vacuum at the intake port 54 drops. Emissions containing $NO_x$ gas will then leak from the valve body. In applications where it is necessary to have zero emissions the present invention can further include a zero emission filtration system 156. Referring to FIGS. 5–6, the zero emission filtration system 156 will include a vent tube 158 extending from the valve body 50 located above the intake port 54 upward to a vent nozzle 160 which protrudes from the cap 132. The vent nozzle 160 serves as an aperture that directs any potential leaking emissions from the valve body 50 to the interior of the cap 132. Once emissions enter inside the cap 132 they will come in contact with a first filter 162. After passing through the first filter 162 the emissions will pass through a second filter 164 before being released to the atmosphere via the atmospheric vents 166 molded on the surface of the cap 132. The function of the first and second filters 162,164 is to filter out environmentally harmful compounds contained in the emission gas. The first filter 162 can be made out of open cell foam such as a 4–800 CHARCOAL Z SIF II FELT filter. The first filter 162 functions primarily to filter out any larger size particles that may be in the emissions gas. The second filter 164 is an activated carbon filter that functions to filter out the environmentally harmful compounds before they are released into the atmosphere through the atmospheric vents 166.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A control cap comprising:
a cap;
a pocket formed in said cap;
a first conduit disposed through said cap having one end of said first conduit terminating in said pocket;
a second conduit disposed through said cap having one end of said second conduit terminating in said pocket;
a sensor having a first tower positioned inside of said first conduit and a second tower positioned inside of said second conduit, wherein said first tower is configured to sense a first characteristic and transmit a signal value indicative of said value of said first characteristic, and said second tower is configured to sense a second characteristic and transmit a signal value indicative of said value of said second characteristic, and
a seal element molded over said pocket encapsulating said first and second towers within said cap.

2. The control cap of claim 1 wherein said first characteristic is pressure of a fluid from a first source.

3. The control cap of claim 2 further comprising a second characteristic, wherein said second characteristic is pressure of a fluid from a second source.

4. The control cap of claim 1 further comprising a control valve contained inside of said cap, wherein said control valve opens and closes to control the flow of a fluid medium in response to said signal values transmitted by said first and second towers.

5. The control cap of claim 4 further comprising a connector connected to said cap, wherein said connector is configured to facilitate the transmission of said signal values from said first tower and said second tower out of said cap and said connector is configured to receive a control signal and transmit said control signal to said control valve.

6. The control cap of claim 1 wherein said first tower has a first die well positioned inside of said first conduit and said first die well is sealed to the wall of said first conduit in order to isolate first characteristic from said pocket.

7. The control cap of claim 6 wherein said tower further comprises a lead frame positioned in said pocket, wherein said first die well and said second die well are connected to said lead frame and said lead frame is connected to said connector, wherein said lead frame transmits said signal values from said first tower and said second tower out of said cap.

8. The control cap of claim 5 wherein said second tower has a second die well positioned inside of said second conduit and said second die well is sealed to the wall of said second conduit in order to isolate said second characteristic from said pocket.

9. The control cap of claim 1 further comprising a vacuum regulator contained within said cap, wherein said vacuum regulator is configured to control said value of said second characteristic.

10. The control cap of claim 9 wherein said second characteristic is the vacuum pressure within said cap and said vacuum regulator controls said vacuum pressure pressure by opening and closing a valve that allows atmospheric pressure to enter said cap when said vacuum regulator is in a closed position.

11. The control cap of claim 9 wherein said vacuum regulator is a solenoid operated valve that is biased to an open position when said solenoid is de-energized.

12. The control cap of claim 1 further comprising an emissions filtration system contained within said cap.

13. The control cap of claim 12 wherein said emissions filtration system has an inlet nozzle disposed through the exterior surface of said cap, a first filter contained inside said cap adjacent said nozzle, second filter located adjacent said first filter and one or more atmospheric vents located adjacent said second filter, wherein emissions enter said cap through said inlet nozzle, flowed through said first filter, flowed through said second filter and released through one or more atmospheric vents in the exterior surface of said cap.

14. A control valve comprising:

a valve body having an inlet port and an outlet port;

a valve member moveable supporting within said valve body between open and closed positions, wherein said valve member controls the flow of a fluid medium between said inlet port and said outlet port;

a diaphragm housing operatively mounted to said valve body and supported by said valve body, said diaphragm housing defines a vacuum cavity in a fluid communication with a source of second pressure and a diaphragm member disposed therebetween and operatively connected to said valve member, said diaphragm member moveable in one direction in response to a negative pressure induced in said vacuum cavity and in an opposite direction in response to a biasing force to move said valve member between said open and closed positions;

a control cap connected to said valve body;

a vacuum regulator contained within said control cap and operatively connected to said diaphragm housing, said vacuum regulator operable to control the movement of said valve member between said opened and said closed positions by controlling the negative pressure induced in said vacuum cavity;

a first conduit disposed partially through said cap, wherein said first conduit has one end operatively connected to said valve body near said inlet port;

a second conduit disposed partially through said cap, wherein said second conduit has one end operatively connected to said vacuum cavity;

a sensor having a first tower positioned inside of said first conduit and a second tower positioned inside of said second conduit, wherein said first tower in configured to sense a first characteristic inside of said first conduit and transmit a signal value indicative of said value of said first characteristic, and said second tower is configured to sense a second characteristic inside of said second conduit and transmit a signal value indicative of said value of said second characteristic; and a seal element molded over said first and second towers to contain said first and second towers within said cap.

15. The control cap of claim 14 wherein said first characteristic is pressure of a fluid within said valve body adjacent said valve body near said port.

16. The control cap of claim 15 further comprising a second characteristic, wherein said second characteristic is pressure of a fluid within said cap.

17. The control cap of claim 14 further comprising a connector connected to said cap, wherein said connector is configured to facilitate the transmission of said signal values from said first tower and said second tower out of said cap and said connector is configured to receive a control signal and transmit said control signal to said control valve.

18. The control cap of claim 14 wherein said tower further comprises a lead frame positioned in said pocket, wherein said first die well and said second die well are connected to said lead frame and said lead frame is connected to said connector, wherein said said lead frame transmits said signal values from said first tower and said second tower out of said cap.

19. The control cap of claim 14 wherein said first tower has a first die well positioned inside of said first conduit and said first die well is sealed to the wall of said first conduit in order to isolate said first characteristic from said pocket.

20. The control cap of claim 19 wherein said second tower has a second die well positioned inside of said second conduit and said second die well is sealed to the wall of said second conduit in order to isolate said second characteristic from said pocket.

21. The valve of claim 14 wherein said vacuum regulator comprises a solenoid assembly having a solenoid coil supported in said cap and a valve member which is moveable between open and closed positions in response to an electromagnetic force generated by said solenoid coil to control the pressure in said vacuum cavity.

22. The valve of claim 14 wherein said cap is integrated to said valve body forming a one piece valve-cap body.

23. A control valve comprising:

a valve body having an inlet port and an outlet port;

a valve member moveable supporting within said valve body between open and closed positions, wherein said valve member controls the flow of a fluid medium between said inlet port and said outlet port;

a diaphragm housing operatively mounted to said valve body and supported by said valve body, said diaphragm housing defines a vacuum cavity in a fluid communication with a source of second pressure and a diaphragm member disposed therebetween and operatively connected to said valve member, said diaphragm member moveable in one direction in response to a negative pressure induced in said vacuum cavity and in an opposite direction in response to a biasing force to move said valve member between said open and closed positions;

a control cap connected to said valve body;

a vacuum regulator contained within said control cap and operatively connected to said diaphragm housing, said vacuum regulator operable to control the movement of said valve member between said opened and said closed positions by controlling the negative pressure induced in said vacuum cavity;

a first conduit disposed partially through said cap, wherein said first conduit has one end operatively connected to said valve body near said inlet port;

a second conduit disposed partially through said cap, wherein said second conduit has one end operatively connected to said vacuum cavity;

a sensor having a first tower positioned inside of said first conduit and a second tower positioned inside of said second conduit, wherein said first tower in configured to sense a first characteristic inside of said first conduit and transmit a signal value indicative of said value of said first characteristic, and said second tower is configured to sense a second characteristic inside of said second conduit and transmit a signal value indicative of said value of said second characteristic; and a seal element molded over said first and second towers to contain said first and second towers within said cap;

an emission filtration system having a vent tube having a first end connected to said valve body between said intake port and said diaphragm and a second end of said vent tube connected to said cap adjacent said solenoid, a nozzle connected through said cap, wherein said nozzle has an aperture extending to the interior portion of said cap and a first filter contained inside of said cap adjacent said aperture of said nozzle, a second filter positioned adjacent said first filter and one or more atmospheric vents located adjacent said second filter.

24. The control cap of claim 23 wherein said first characteristic is pressure of a fluid from a first source.

25. The control cap of claim 24 further comprising a second characteristic, wherein said second characteristic is pressure of a fluid from a second source.

26. The control cap of claim 23 further comprising a connector connected to said cap, wherein said connector is configured to facilitate the transmission of said signal values from said first tower and said second tower out of said cap and said connector is configured to receive a control signal and transmit said control signal to said vacuum regulator.

27. The control cap of claim 23 wherein said tower further comprises a lead frame positioned in said pocket, wherein said first die well and said second die well are connected to said lead frame and said lead frame is connected to said connector, wherein said lead frame transmits said signal values from said first tower and said second tower out of said cap.

* * * * *

UNITED STATES PATENT AND TRADEMARK OFFICE

CERTIFICATE OF CORRECTION

PATENT NO. : 6,997,170 B2
DATED : February 14, 2006
INVENTOR(S) : Aaron Feiner et al.

It is certified that error appears in the above-identified patent and that said Letters Patent is hereby corrected as shown below:

Column 5,
Line 48, "includes and integrated" should be -- includes an integrated --.

Column 8,
Line 65, "vacuum pressure pressure by" should be -- vacuum pressure by --.

Column 10,
Line 5, "wherein said said lead" should be -- wherein said lead --.

Signed and Sealed this

Ninth Day of May, 2006

JON W. DUDAS
*Director of the United States Patent and Trademark Office*